US005408776A

United States Patent [19]

Mahn et al.

[11] Patent Number: 5,408,776

[45] Date of Patent: Apr. 25, 1995

[54] MUZZLE LOADING FIREARM IGNITION SYSTEM

[76] Inventors: Gary Mahn, 9470 Oriole Dr., Coopersville, Mich. 49404; Gary Bowman, 871 Dolphin St., SW., Wyoming, Mich. 49509

[21] Appl. No.: 65,190

[22] Filed: May 20, 1993

[51] Int. Cl.[6] ..... F41C 7/00

[52] U.S. Cl. ..... 42/51; 89/1.3; 89/27.13; 42/69.02

[58] Field of Search ..... 89/1.3, 27.13; 42/51, 42/69.02, 16

[56] References Cited

U.S. PATENT DOCUMENTS

| | | | |
|---|---|---|---|
| 2,299,086 | 10/1942 | Garand | 89/1.3 |
| 3,780,464 | 12/1973 | Anderson | 42/51 |
| 4,114,303 | 9/1978 | Vaughn . | |
| 4,135,321 | 1/1979 | Lewallyn . | |
| 4,163,335 | 8/1979 | Ives . | |
| 4,186,506 | 2/1980 | Pawlak et al. . | |
| 4,227,330 | 10/1980 | Chapin . | |
| 4,232,468 | 11/1980 | Chapin . | |
| 4,283,874 | 8/1981 | Vaughn . | |
| 4,384,423 | 5/1983 | Ritchie . | |
| 4,437,249 | 3/1984 | Brown et al. . | |
| 4,461,109 | 7/1984 | Eguizabal . | |
| 4,700,499 | 10/1987 | Knight . | |
| 5,016,379 | 5/1991 | Lambert . | |

FOREIGN PATENT DOCUMENTS

| | | | |
|---|---|---|---|
| 299148 | 12/1919 | Germany | 89/1.3 |

*Primary Examiner*—Stephen M. Johnson
*Attorney, Agent, or Firm*—Varnum, Riddering, Schmidt & Howlett

[57] ABSTRACT

An improved ignition means for a muzzle loading weapon which is adapted to fire a projectile, and comprises a barrel, an ignition means adapted to receive a primer charge comprising a cylindrical casing having an explosive charge within, and an annular flange at one end which extends outwardly radially from the casing, and a hammer adapted to ignite the primer charge. The improved ignition means comprises a primer receiver having a well with a distal portion and a proximal portion. The distal portion communicates with a powder charge receiving portion of the barrel, and the proximal portion has an open end. The proximal portion of the well has a first diameter, and the distal portion of the well has a smaller second diameter. The second diameter is less than a predetermined diameter of a primer cylindrical casing and is spaced from the open end a distance less than a predetermined length of a primer, so that when a primer charge is inserted into the well through its open end, the primer charge casing frictionally engages the smaller diameter of the proximal portion to hold the primer charge within the well with its annular flange outside of the well and spaced from the opening. Additionally, a tool is provided for grasping a primer to insert it into the well and for prying a recalcitrant primer out of the well.

17 Claims, 5 Drawing Sheets

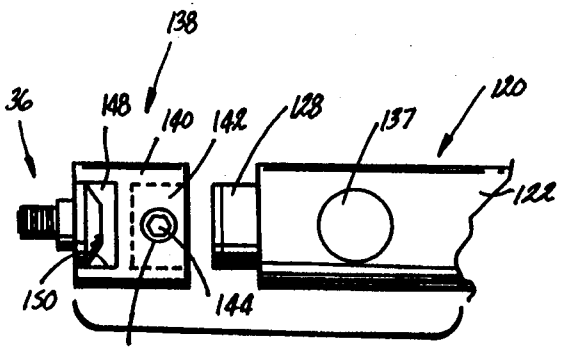
Fig. 14
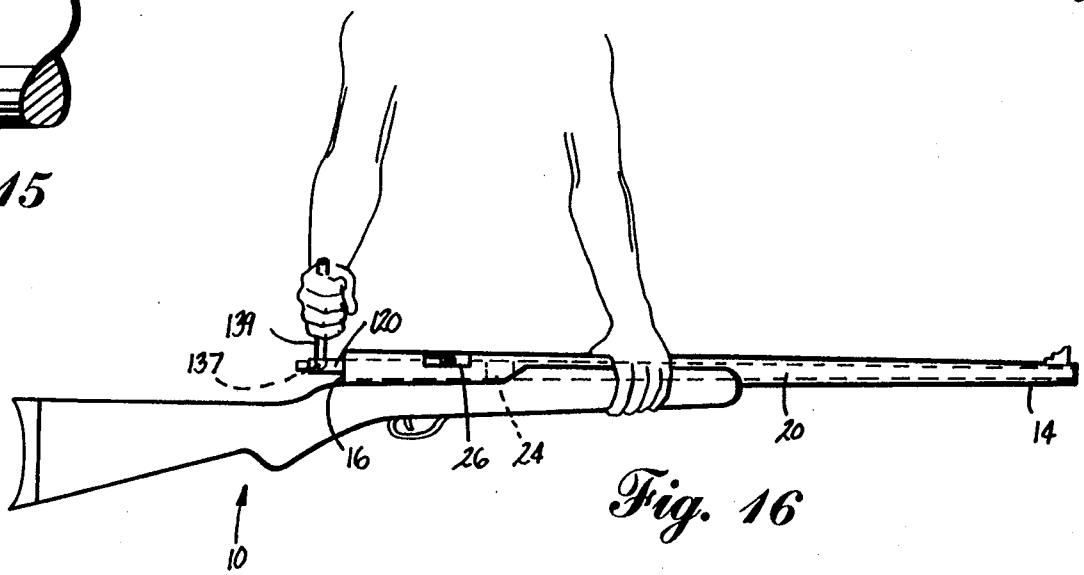
Fig. 16
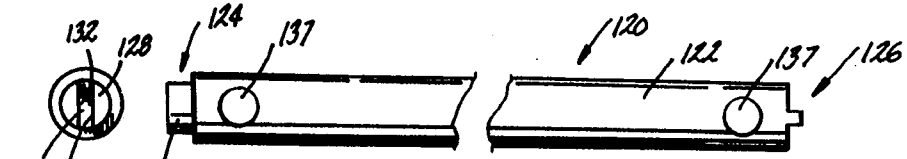
Fig. 12
Fig. 13
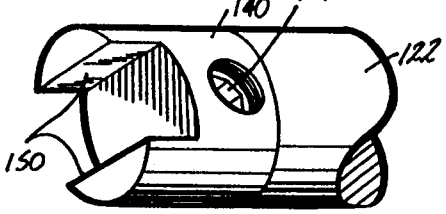
Fig. 15
138

MUZZLE LOADING FIREARM IGNITION SYSTEM

BACKGROUND OF THE INVENTION

1. Field of the Invention

This invention relates generally to firearms and, more particularly, to a muzzle loading firearm with an improved ignition system.

2. State of the Prior Art

Hunting with muzzle loading firearms has become increasingly popular in the last few years. Many hunters prefer to use muzzle loading rifles because a game animal has a greater chance to escape with its life, and, thus, the hunter's skill can be more adequately tested. Some hunters also enjoy the muzzle loading routine of pouring powder down the rifle barrel, packing it, and driving a shot down the barrel. Some states even have a separate hunting season for sportsmen with muzzle loading firearms.

Hunting with muzzle loading rifles presents several additional challenges. Most muzzle loading weapons used by hunters fire by means of a cup-shaped percussion cap which contains a small explosive charge ignitable upon application of a sufficient impact. The percussion cap is placed over a nipple. A passageway through the nipple and into the barrel of the weapon passes the hot gasses produced when the percussion cap is ignited. Typically, the muzzle loading hunting season occurs at a time of the year when the weather is cold and inclement. Percussion caps are well known for being an unreliable ignition source in such weather. They absorb moisture and may become waterlogged and unusable. Also, they contain only a small charge. A further inconvenience of percussion caps becomes apparent when a hunter attempts to remove a spent cap from the nipple in the field. Sometimes the cap is very difficult to pry off of the nipple, especially with cold fingers.

To overcome the inadequacies of percussion caps as an ignition source, some gun designers employ shotgun shell primers as an ignition source. Shotgun shell primers are primarily used as the ignition source for shotgun shells for regular breech loading shotguns, but make an excellent ignition source for a muzzle loading weapon. They comprise a tubular metal casing, an annular flange at one end of the casing and extending outwardly radially therefrom, a charge of explosive material, and a hole at the opposite end from the flange for expelling the hot gasses from the explosion.

Shotgun shell primers are much less susceptible to the ravages of damp weather and rarely become waterlogged unless immersed in water. Shotgun shell primers also contain a much larger charge of explosive material for a more reliable ignition of the black powder charge. However, previous ignition systems for muzzle loading weapons designed to use shotgun shell primers as an ignition source require that the primer be inserted into a tight fitting well until the annular flange prevents the primer from being inserted further. The primer must fit snugly into the well to prevent it from falling out. Many times gasses and ash blowing back into the ignition system from the exploding black powder charge dirty the well. When this happens, the primer is very difficult to insert and remove. Even when the well is relatively clean, the primer is difficult to remove with cold hands.

A second problem with muzzle loading weapons is accuracy. One element of inaccuracy is a relatively long lock time compared with conventional breech-loading weapons. Lock time is measured from the time the trigger is squeezed until the black powder charge launching the bullet actually fires. Many muzzle loading weapons employ a traditional swing hammer mounted on the side of the barrel, which swings through an arc and strikes a percussion cap. The hot gasses from the cap must travel a long, and sometimes circuitous, path into the barrel before igniting the black powder charge. Also, if only the side of the charge is ignited it may not burn evenly. The longer the lock time, the longer the shooter has to hold the rifle steady and on target. Even very small delays can cause inaccuracies due to the physical inability of even the best shooters to hold the weapon completely still. Small movements of the rifle greatly affect the bullet's path.

To reduce lock time, it is desireable to have a fast hammer and a short direct path from the ignition source into the black powder charge. Recently, in-line firing systems have gained some popularity for their inherently faster lock times, thus higher accuracies. The firing mechanism and ignition source are lined up immediately behind the black powder charge to reduce the distance the hammer has to travel and also the distance that the hot gasses have to travel. The gasses enter the barrel axially to reduce uneven burning of the black powder charge. If used with a shotgun shell primer, lock time may be further reduced by providing a hotter spark to more quickly ignite the black powder charge.

A drawback of such systems is the awkward placement of the percussion cap nipple or primer well inside the barrel. Typically they are accessed through an opening in the side of the barrel. Access is difficult because of the small space for putting one's fingers. In cold weather, access is even more difficult due to the limited mobility of cold fingers.

SUMMARY OF THE INVENTION

The present invention overcomes the disadvantages of difficult loading and removal of primers, making them a practical ignition source for in-line or other firing systems and is directed to an improvement in a muzzle loading firearm having a barrel, and an ignition means for receiving a primer charge. The primer charge comprises a cylindrical casing of predetermined diameter and predetermined length, having an explosive charge within and an annular flange at one end which extends outwardly radially from the casing. The firearm further has a hammer adapted to ignite the primer charge.

In accordance with the invention, an improvement in the ignition means comprises a primer receiver having a well with a distal portion and a proximal portion. The distal portion communicates with the barrel, and the proximal portion has an open end. A first diameter of the proximal portion is nominally greater than the predetermined diameter, and a second diameter of the distal portion is less than the predetermined diameter. The second diameter is spaced from the open end a distance less than the predetermined length. Thus, when the primer charge is received in the well through the open end, the cylindrical casing frictionally engages the distal portion at the second diameter to hold the primer charge within the well, with the annular flange spaced from the open end.

Preferably, the hammer is coaxial with the primer receiver and with the barrel. A pin can extend from the hammer in a position to strike a primer charge received in the well, the pin having a diameter substantially less than the predetermined diameter. The pin can comprise a conical projection extending from the hammer. Preferably, a stop extends further from the hammer than the pin, to limit movement of the hammer toward a primer charge received in the well. The stop can comprise an annular flange encircling the pin and extending axially from the hammer.

Further in accordance with the invention, a tool provides for inserting and removing a primer charge from the well. The tool may comprises a body having an insertion end. An open ended first notch extends into the insertion end, and has a width wider than a primer charge casing. A second open ended notch extends into the insertion end transverse to the first notch, having a width adapted to loosely receive a primer charge annular flange. A primer charge may be received in the first notch with its annular flange received within the second notch, thereby facilitating placement of the primer charge into the well.

The tool may comprise a body having a removal end, with a first tool face and a second tool face, wherein the first tool face converges toward the second tool face at the removal end to form a wedge shape. A third notch, open at the removal end, is wider than the predetermined diameter. Thus, a primer charge may be removed from the well by prying the removal end of the tool between the primer annular flange and the primer receiver.

Preferably, a first face on the primer receiver, at its open end, slopes away from the open end. Preferably, the first face slopes away from the opening at an angle greater than 10 degrees, or at an approximately 25 degree angle.

With a sloping first face on the primer receiver, the stop preferably terminates in a second face, having a corresponding slope with the first face, whereby the second face can contact the first face in relatively parallel abutment.

Preferably, the primer receiver is coaxially positioned within the barrel. Also, a breech plug can be coaxially positioned within the barrel, and have a coaxial bore therethrough which receives the primer receiver.

An accessory tool can be provided for a disassembly tool comprising an elongated body, a cylindrical projection extending axially from one end of the tool body, and first axial slot into the cylindrical extension forming a first pair of parallel spaced-apart faces. The accessory tool comprises a cylindrical body, and a coaxial bore extending axially into one end of the accessory tool body, which is adapted to snugly receive the cylindrical extension of the disassembly tool. A second slot extends axially into the opposite end of the accessory tool body and forms a second pair of spaced-apart parallel faces. Means are provided for fixedly securing the accessory tool upon the cylindrical extension of the disassembly tool. The primer receiver further comprises a pair of flat parallel lands, whereby the spaced-apart parallel faces of the accessory tool can grasp the lands on the primer receiver.

In accordance with the invention an ignition assembly kit for a muzzle loading firearm comprises a primer receiver for receiving a primer charge, a removal tool for removing a primer charge, and an accessory tool for use on a disassembly tool.

BRIEF DESCRIPTION OF THE DRAWINGS

The invention will now be described with reference to the accompanying drawings in which:

FIG. 12 is a plan view of a disassembly tool;

FIG. 13 is an end view of a primer cap nipple end of the disassembly tool of FIG. 12;

FIG. 14 is an exploded view of the primer cap nipple end of the disassembly tool of FIG. 12, and an accessory tool according to the invention;

FIG. 15 is a perspective view of the accessory tool of FIG. 14, shown installed upon the disassembly tool of FIG. 12;

FIG. 16 is a plan view of the muzzle loading rifle of FIG. 1, illustrating the use of the disassembly tool of FIG. 12;

DETAILED DESCRIPTION OF THE DRAWINGS

Figure 1:
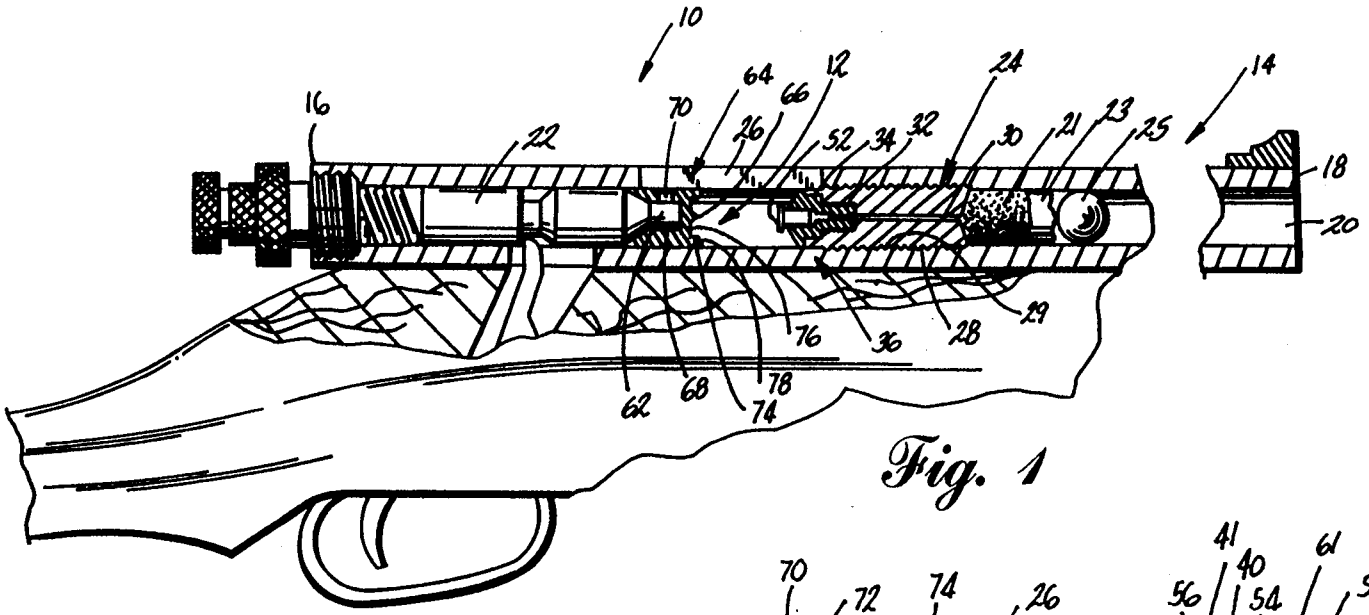
FIG. 1 is a front elevational view in partial section of an in-line firing muzzle loading rifle incorporating an ignition system according to the invention.

Referring now to the drawings, FIG. 1 shows a muzzle loading rifle 10 incorporating an ignition system 12 according to the present invention. The rifle 10 comprises a barrel 14 having a rear or breech end 16, a forward end 18, and a bore 20 therethrough. A bolt 22 is axially aligned with the bore 20 of the barrel and extends into the bore 20 from the breech end 16 of the barrel 14. The bolt 22 is spring loaded and fires the gun 10 in a conventional manner. U.S. Pat. No. 4,700,499 to Knight issued Oct. 20, 1987, more fully illustrates the structure and operation of a conventional in-line firing bolt such as that illustrated at 22.

The muzzle loading rifle 10 incorporates a breech plug 24 near the breech end 16 of the barrel 14. When the rifle 10 is loaded, a charge of black powder 21, wadding 23 and shot 25 sits in the bore 20 of the barrel 14 just forward of and against the breech plug 24. The breech plug 24 is cylindrical and has threads 28 on its outer surface which engage corresponding threads 29 in the bore of the barrel 20. A narrow diameter central bore 30, passes axially through the breech plug 24 and is generally coaxial with the bore of the barrel 20 when the breech plug 24 is installed therein. A threaded intermediate diameter bore 32 is countersunk into the rear end of the breech plug 24 and is coaxial with the breech plug central bore 30. A large diameter smooth outer bore 34 countersunk into bore 32 is generally coaxial to the intermediate and central bores 32 and 30.

In prior art weapons, a percussion cap nipple (not shown) screws into the intermediate bore 32 and receives a cup shaped percussion cap (not shown). The conventional percussion cap nipple for an in-line fired rifle 10, has a central bore axially aligned with the breech plug central bore 30. The gun 10 fires when the bolt 22 strikes and ignites the percussion cap. Hot gasses from the percussion cap travel through nipple, the central bore 30 of the breech plug 24 and into the charge of black powder in the barrel 14 of the rifle 10.

Figure 2:
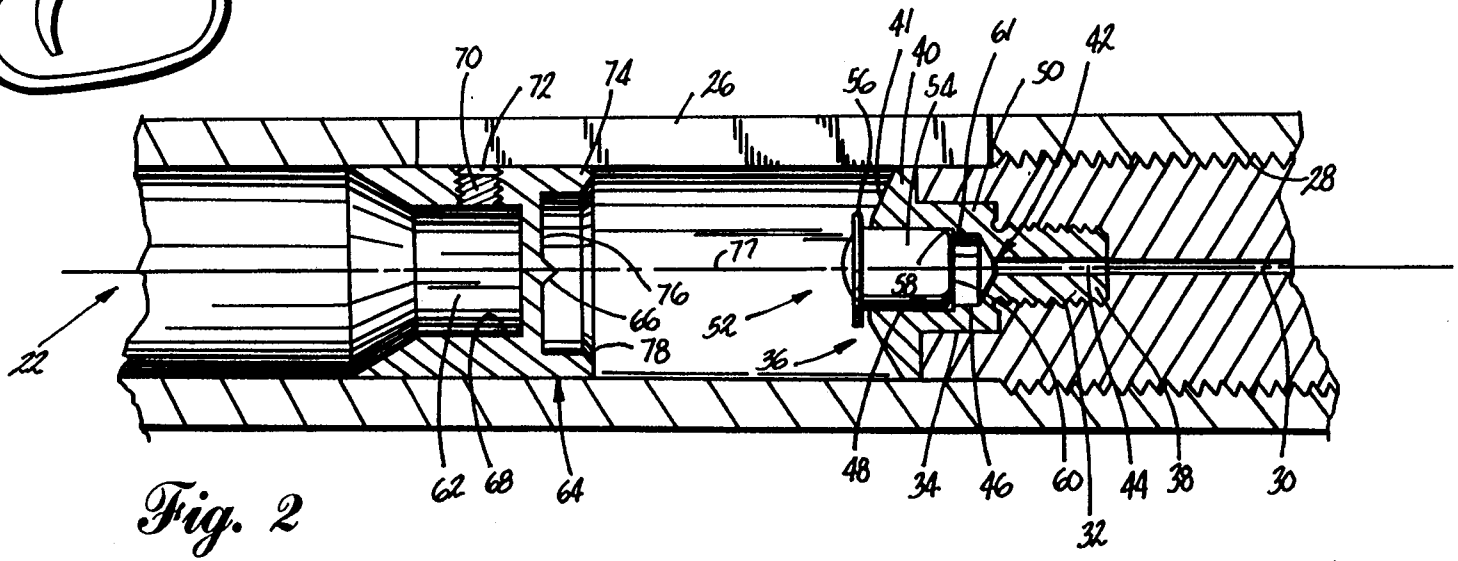
FIG. 2 is a detailed front elevational view in section of the ignition system of FIG. 1, shown with the bolt retracted.
Figure 3:
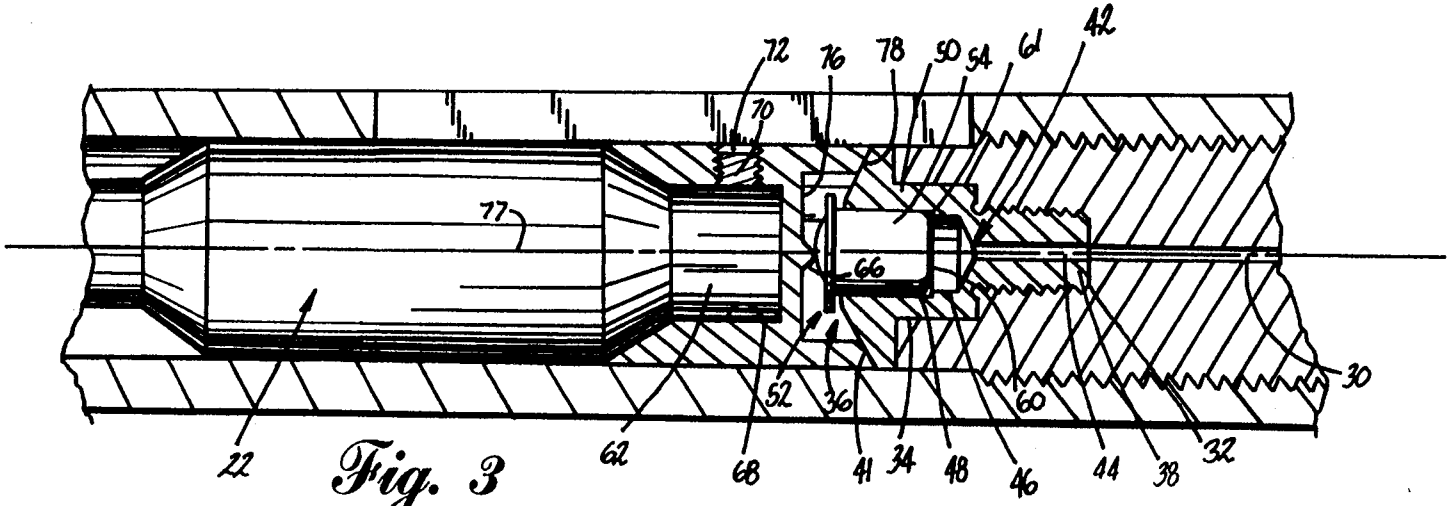
FIG. 3 is a detailed front elevational view in section of the ignition system of FIG. 1, shown with the bolt extended.
Figure 4:
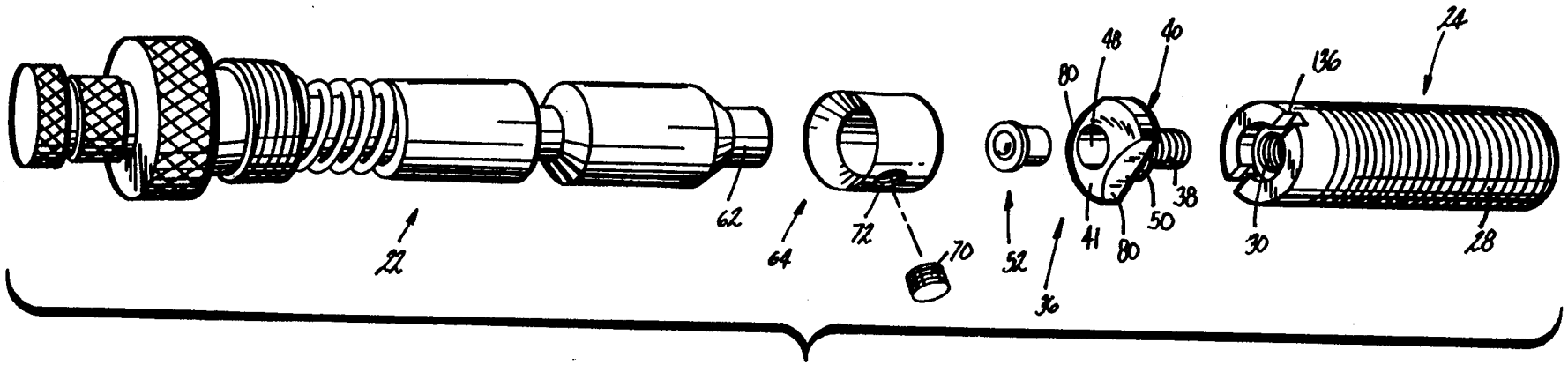
FIG. 4 is an exploded view of the ignition system of FIG. 1.
Figure 6:
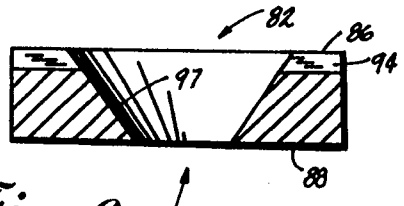
FIG. 6 is a sectional view taken along lines 6—6 of FIG. 5.

The ignition system 12 of the present invention replaces the prior art percussion cap nipple with a primer receiver 36 and is shown in greater detail in FIGS. 2–4. The primer receiver 36 comprises a threaded stem 38, an annular flange 40 extending radially outwardly from one end of the stem 38, and a central coaxial bore 42 extending through the primer receiver 36. The bore 42 is divided into three sections, each having a different inside diameter. The first section 44 at the free end of the stem 38 has a small inside diameter (approximately 0.040 inches) and is adapted to communicate directly with the central bore 30 of the breech plug 24. An intermediate section 46 of the primer receiver bore 42 has a slightly larger inside diameter, and the other end of the axial bore 42 has an even larger inside diameter to form a primer receiving well 48. The stem 38 of the primer receiver 36 threads into the intermediate bore 32 in the breech plug 24. An annular shoulder 50 can be provided at the transition between the annular flange 40 and the stem 38 to more accurately conform the primer receiver 36 to the outer bore 34 of the breech plug 24. The flange 40 has an external face 41 sloped at an approximately 25 degree angle from the normal to the axis of the bore 42. An opening 26 (see also FIG. 16) through the side of the barrel 14, to the rear of the breech plug 24, provides access to the ignition system 12.

The ignition system 12 of the present invention is adapted to use a standard shotgun shell primer 52 as an ignition source in place of a percussion cap. An example of a suitable primer 52 is a Model 209 type primer commercially available from Remington Arms Company, Inc., Bridgeport, Conn. The shotgun shell primer 52 comprises generally a cylindrical casing 53 and an annular flange 56, extending outwardly radially from one end of the casing 53. At the opposite end of the primer 52, the casing 56 curves through a rounded transition section 58 to form a forward end 60 of the primer 36. Shotgun shell primers 52 are much more reliable ignition sources than standard percussion caps; they carry a larger charge and are better sealed from the environment.

The penetration depth of the primer receiving well 48 into the primer receiver 36 is shallower than the distance between the forward end 60 of the primer 52 and the annular flange 56, so that when the primer 52 is fully inserted into the primer receiving well 48, a portion of the primer 52 projects outwardly from the primer receiving well 48. Preferably, the primer receiving well 48 has an internal diameter between 0.248 and 0.249 inches, and the intermediate section 46 has an internal diameter between 0.238 and 0.239 inches. The depth of the primer receiving well 48 should be between 0.215 and 0.210 inches for a Remington Model 209 shotgun shell primer. A transition section 61 between the primer receiving well 48 and the intermediate section 46 can be sharp, as shown in FIG. 2, or tapered or rounded. The transition section 61 preferably frictionally engages the rounded transition section 58 of the primer 52. The large diameter of the primer receiving well 48 reduces the opportunity for dirt and grime, which naturally builds up on the walls of the primer receiving well 48, from restricting the diameter of the primer receiving well 48 to the point where removal of the primer 52 becomes arduous.

The forward end of the standard bolt 22 tapers to a cylindrical hammer 62 of lesser diameter than the bolt and adapted for firing a percussion cap. However, shotgun shell primers 52 are designed to be fired by a narrow diameter firing pin. Accordingly, an adapter 64, incorporating a narrow diameter firing pin 66, is provided for attachment to the hammer 62. The adapter 64 is generally cylindrical and has a bore 68 at its rear end which receives the cylindrical hammer 62. Three axial bores 72, equally spaced about the circumference of the adapter 64, penetrate through the adapter 64 into the bore 68. Set screws 70 thread through the bores 72 and frictionally contact the hammer 62 to hold the adapter 64 firmly upon the hammer 62.

An annular flange 74, having the same external diameter as the adapter 64, extends axially from a forward end 76 of the adapter 64 to act as a stop. A forward edge 78 of the annular flange 74 is bevelled inwardly at an approximately 25 degree angle, so that the forward edge 78 will mate smoothly with the sloped face 41 of the primer receiver 36. The firing pin 66 is located in the center of the adapter front end 76 and has a generally conical shape. Preferably, its sides are at a 30 degree angle to a central axis 77 of the adapter 64.

The annular flange 74 is sized so that when the bolt extends forwardly to fire the primer 52, the front edge 78 of the annular flange 74 will contact the sloped face 41 of the primer receiver 36 and allow the firing pin 66 to penetrate the primer 52 sufficiently to ignite the primer but prevent further application of force to the primer 52 than is necessary for ignition thereof, as illustrated in FIG. 3. Preferably, the firing pin 66 will penetrate the primer 52 a mere 0.040 inches before the sloped front edge 78 contacts the sloped face 41 of the primer receiver, stopping forward movement of the bolt 22. The annular flange 74 thus prevents the bolt 22 from impacting the primer 52 into the primer receiving well 48, making extraction of the primer 52 from the primer receiving well difficult.

FIG. 4 is an exploded view of the bolt 22, adapter 64, primer 52, primer receiver 36, and breech plug 24. It also clearly shows that the annular flange 40 of the primer receiver 36 has two parallel, chord like, flat sides 80. The flat sides 80 provide a gripping surface to facilitate the installation and removal of the primer 36 from the breech plug 24, as will be more fully explained hereinafter.

Returning to FIG. 1, the primary disadvantage of prior in line shotgun shell primer fired muzzle loader ignition systems is the difficulty with which a primer 52 is loaded into the weapon prior to firing, and even more importantly, the difficulty of removing the primer 52 from the weapon after firing. The side opening 26 at the breech end 16 of the barrel 14 is narrow and cramped. Especially with cold fingers, it can be quite difficult to maneuver a tiny primer radially into the barrel 14 and then axially into the primer receiving well 48.

In prior ignition systems employing primers, the primer well is deeper than the length of the primer 52, so that the primer 52 is inserted into the well until the primer annular flange 56 contacts a face of the primer receiver. Typically, the entire side of the primer well frictionally contacts the primer casing. When combustion by-products build up on the walls of the primer well, the effective diameter of the well reduces, making insertion and removal of the primer more difficult. With the primer flange in contact with the primer receiver, grasping the primer becomes very difficult.

In the current invention, the primer annular flange 56 remains well outside of the primer receiving well 48. The diameter of the primer receiving well 48 is large enough to easily receive the primer casing 54, even if the primer receiving well 48 has an accumulation of grime and firing by-products from previous firings of the weapon. Only the smaller transition section 61 frictionally grasps the primer 52. Thus, when the weapon is fired, the blow back gases created by the explosion will generally produce sufficient pressure to eject the primer 52 from the primer receiving well 48. If the blow back gases fail to eject the primer 52, the primer annular flange 56 is spaced sufficiently clear of the sloped face 41 to allow a finger or suitable tool to be inserted into the barrel side opening 26 to pry the primer 52 out of the primer receiving well 48. Typically, this will not be necessary.

Figure 9:
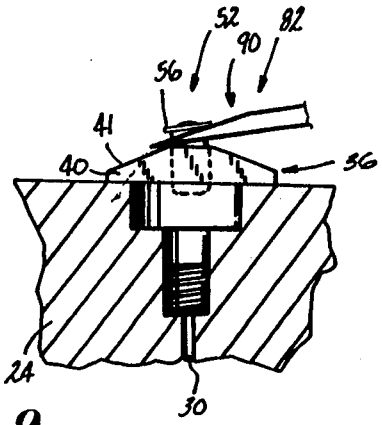
FIG. 9 is a sectional view of the portion of the ignition system of FIG. 8, showing the removal portion of the removal and insertion tool in the process of removing the primer.
Figure 8:
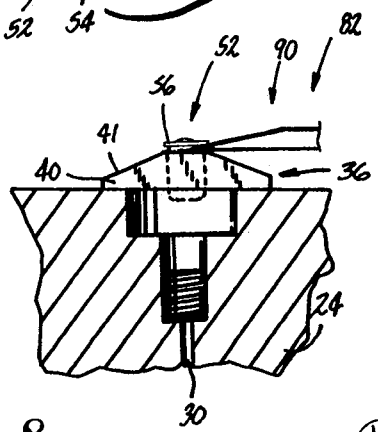
FIG. 8 is a sectional view of a portion of the ignition system of FIG. 1 incorporating a primer receiver and a primer, and showing a removal portion of the removal and insertion tool of FIG. 5.
Figure 5:
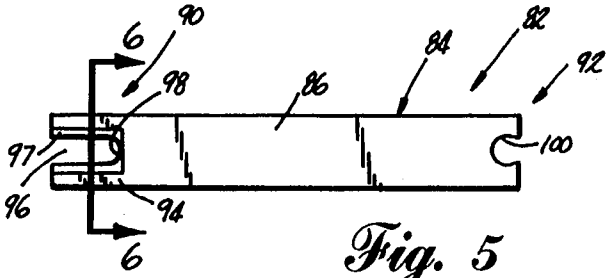
FIG. 5 is a plan view of a primer removal and insertion tool according to the invention.
Figure 7:
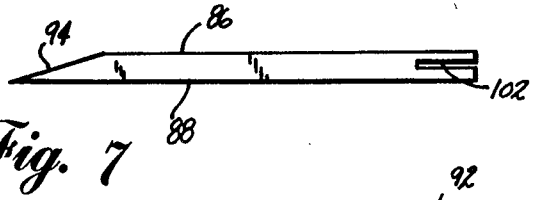
FIG. 7 is an elevational view of the primer removal and insertion tool of FIG. 5.

Turning to FIGS. 5 through 9, and to FIGS. 5 and 7 in particular, a primer tool 82 is shown which facilitates the insertion and removal of primers 52. The primer tool 82 comprises an elongated rectangular prismatic body 84, having generally parallel upper and lower surfaces 86 and 88 respectively. One end of the primer tool 82 comprises a removal tool 90, and the opposite end comprises an insertion tool 92. At the removal tool 90, a portion 94 of the upper surface 86 slopes downwardly to meet the lower surface 88 at an approximately 14 degree angle, forming a wedge. A slot 96, through the upper and lower faces 86 and 88, extends axially into the body 86 of the primer tool 84 from the removal tool end 90. Preferably, the slot 96 has sides 97 which slope at a 45 degree angle to the lower surface 88, so that the slot 96 is narrower at the lower surface 88 than at the sloped upper surface portion 94 (see FIG. 6). The slot 96 has a width at the lower surface 88, which is slightly wider than the diameter of the primer casing 54 (not shown in FIGS. 5–7), and terminates in a rounded edge 98 having a radius adapted to receive the primer casing 54. The slot 96 has an axial depth into the removal tool end 90 of approximately two primer casing diameters. FIGS. 8 and 9 illustrate how the primer removal tool 90 is used to extract a recalcitrant primer 52 from the primer receiving well 48. The sloped face 41 of the primer receiver annular flange 40 facilitates insertion of the primer removal tool 90 between the sloped face 41 and the primer annular flange 56.

Figure 10:
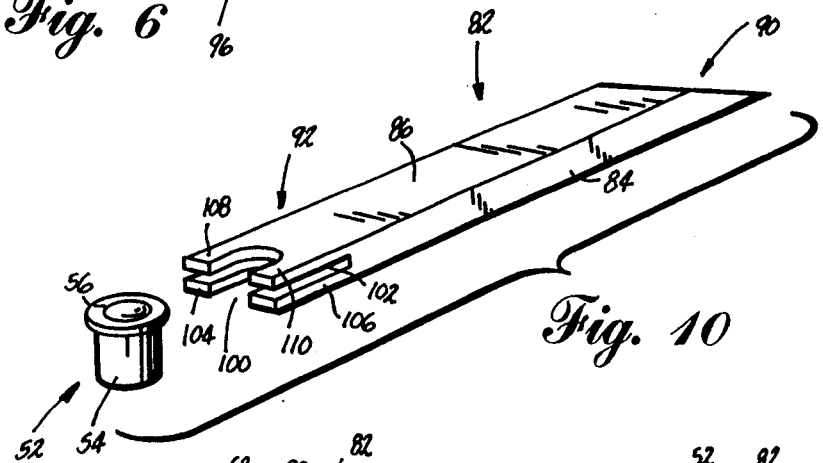
FIG. 10 is a perspective view of the removal and insertion tool of FIG. 5, showing a primer awaiting insertion into an insertion portion of the removal and insertion tool.

Turning to FIG. 10, the insertion tool 92 has a similar slot 100. However, the slot 100 extends axially into the primer tool body 84 less than the diameter of a primer casing 54. A second slot 102 extends axially into the primer tool body 84 at the insertion tool 92. The second slot 102 is normal to the first slot 100, extends the full width of the primer tool body 84, and extends axially into the primer tool body 84, a distance greater than the diameter of the primer casing 54.

Figure 11:
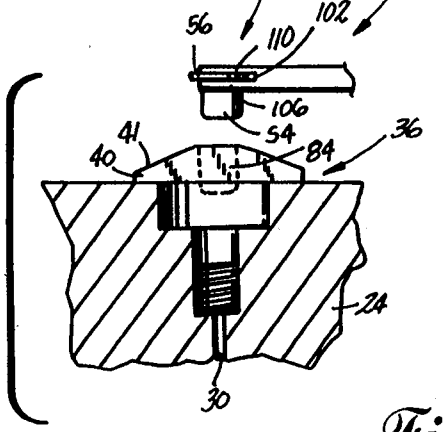
FIG. 11 is a sectional view of a portion of the ignition system of FIG. 1, show of inserting a primer.

The two slots 100 and 102, form a pair of lower fingers 104 and 106 underneath slot 102 and separated by slot 100, and a pair of upper fingers 108 and 110 above slot 102 and separated by slot 100. The distance between the lower fingers 104 and 106, and the upper fingers 108 and 110, is sized to provide a snug fit for the primer annular flange 56. Thus, the primer 52 may be gripped by the insertion tool 92. The primer casing 54 fits into the slot 100 between the lower fingers 104 and 106, and the primer annular flange 56 fits snuggly between the lower fingers 104 and 106 and the upper fingers 108 and 110. FIG. 11 illustrates how the primer insertion tool 92 is used to grip and insert the primer 52 into the primer receiving well 48.

The ignition system 12 is particularly suited for retrofitting an existing in-line style firing black powder rifle employing a percussion cap nipple. FIG. 12 illustrates a disassembly tool 120 commonly used for removing the percussion cap nipple and the breech plug from such a weapon. The disassembly tool 120 comprises an elongate cylindrical body 122, having a percussion cap nipple end 124 and a breech plug end 126. At the percussion cap nipple end 124, a narrower diameter extension 128, coaxial to the main body 122, extends axially from the percussion cap nipple end 124. A central axial slot 130 extends the full diameter and length of the extension 128 to form two parallel spaced apart faces 132 (FIG. 13) adapted to grip a portion on a percussion cap nipple (not shown) so that it may be unscrewed from the breech plug (not shown in FIG. 12). At the breech plug end 126, a screwdriver-like blade 134 extends axially from the main body 122. The blade 134 extends the full diameter of the breech plug end 126 of the body 122, and is adapted to be received within a mating groove 136 in the rear end of the breech plug 24 (see FIG. 4). An axial bore 137 axially penetrates the body 122 near its nipple end 124, and a separate axial bore 137 axially penetrates the body 122 near its breech plug end 126. The axial bores 137 are adapted to receive a rod 139 (see FIG. 16) for increasing the torque a user may apply with the disassembly tool 120.

Turning to FIGS. 14 and 15, an accessory tool 138 is provided for attachment to the disassembly tool 120 for installation and removal of the primer receiver 36 while the breech plug 24 remains within the barrel 14 (see also FIG. 1). The accessory tool 138 comprises a short cylindrical body 140 having a coaxial bore 142 at one end sized to receive the nipple end extension 128. Allen head set screws 144 in threaded apertures 146, extending axially through the body 140 into the bore 142, frictionally abut the extension 128 to firmly hold the accessory tool 138 on the extension 128. At the opposite end of the body 140 from the bore 142, a slot 148 extends axially into the body 140, and spans the full diameter of the body 140 to form two parallel spaced apart faces 150. The spaced apart parallel faces 150 are adapted to grip the flats 80 on the primer receiver 36 (see FIG. 4).

Turning to FIG. 16, operation of the disassembly tool 120 is illustrated. First, the bolt 22 (not shown in FIG. 16) is removed from the barrel 14 in a conventional manner. The disassembly tool 120 is then axially inserted into the barrel bore 20 through its breech end 16. To retrofit an existing percussion fired weapon, the percussion cap nipple (not shown) must first be removed. The percussion cap nipple end 124 of the disassembly tool 120 is inserted into the bore of the barrel and adjusted to receive the flat portions of the percussion cap nipple between the parallel faces 132 formed by the central slot 130 (not shown in FIG. 16). The rod 139 may be inserted into the bore 137 for added leverage. After the percussion cap nipple is removed, the accessory tool 138 is placed on the extension 128 and the set screws 144 are tightened. The primer receiver 136 is inserted into the slot 148 on the accessory tool 138, and the percussion cap nipple end 124 of the disassembly tool 120, carrying the accessory tool 138, is reinserted into the rifle bore 120 to thread the receiver 36 into the breech plug 24.

Figure 17:
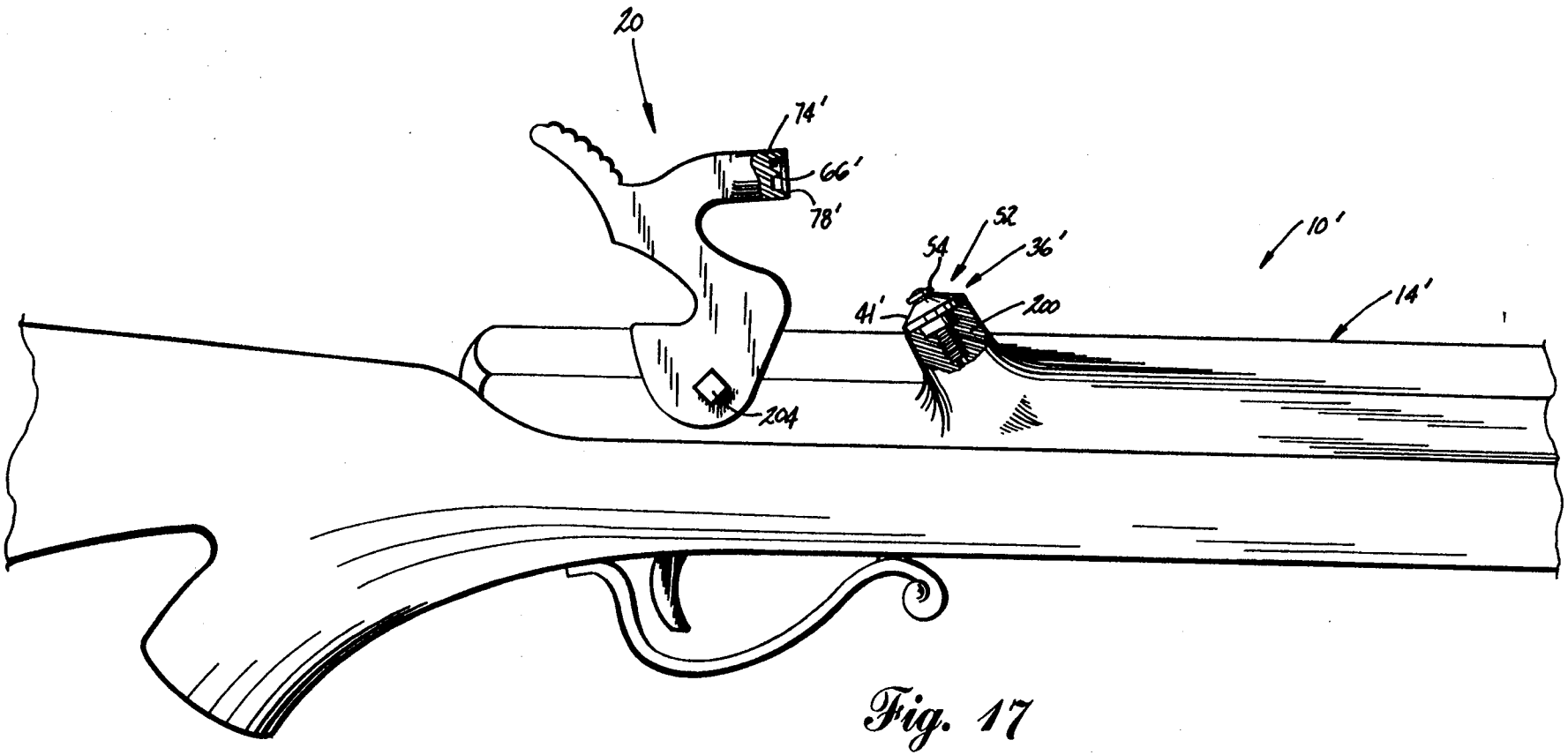
FIG. 17 is a front elevational view in partial section of a second embodiment of an in-line firing muzzle loading rifle incorporating an ignition system according to the invention.

As illustrated in FIG. 17, wherein like parts of the previous embodiment are numbered with like primed numerals, the invention is not limited to in line firing weapons, and is suitable for use with other types of muzzle loading ignition systems. For instance, the invention is particularly well suited for use with a swing hammer type ignition system. In a conventional swing hammer ignition system employing a percussion cap nipple, a swing hammer rotates through an arc when the weapon's trigger is pulled, striking a percussion cap placed upon a nipple on the weapon. A passageway from the percussion cap nipple leads into the charge within the barrel to fire the weapon. The path from the percussion path nipple into the interior of the barrel where the charge is held is not axially aligned with the barrel, and generally must make at least one, if not several, turns. With such a circuitous path, the added ignition power of a primer over a percussion cap nipple provides greatly increased reliability.

As shown in FIG. 17, the primer receiver 36' threads into a threaded bore 200 which previously received a percussion cap nipple. Of course, the primer receiver 36' could also be integrally formed with the barrel 14', and not threaded thereon as shown on FIG. 17. A swing hammer 202 pivots about an axis 204. The hammer 202 includes the firing pin 66' as previously described with reference to the in line firing design, as well as the annular flange 74' with its sloped front edge 78' which encircles the firing pin 66'. As in the previous embodiment, the firing pin 66' strikes the primer 52 to fire the weapon 10', and the annular flange front edge 78' contacts the primer receiver annular flange sloped face 41' to limit the movement of the firing pin 66' into the primer 52. The primer receiver 36' engages the primer 52 as in the previous embodiment, and is essentially identical to the primer receiver 36 previously described.

To retrofit an existing swing hammer percussion cap fired weapon, the percussion cap nipple is replaced with the primer receiver 36', and the swing hammer is replaced with the swing hammer 202. Alternatively, the existing swing hammer can be modified with an adapter similar to the adapter 64 previously described, incorporating the firing pin 66' and preferably the annular flange 74. Although the primer 52 is more accessible in the swing hammer design type of weapons, the primer insertion and removal tool 82 is also useful with this type of design.

Reasonable variation and modification are possible within the scope of the foregoing disclosure and drawings without departing from the spirit of the invention, as defined in the accompanying claims. For instance, the ignition system 12 could be adapted to hold a standard rifle cartridge primer.

The embodiments of the invention in which an exclusive property or privilege is claimed are as follows:

1. In a muzzle loading firearm comprising a barrel, an ignition means for receiving a primer charge comprising a cylindrical casing of predetermined diameter and predetermined length, having an explosive charge within, a forward end of the casing and an annular flange at an opposite end of the casing which extends outwardly radially from the casing, and said firearm further having a hammer adapted to ignite such primer charge received in the ignition means, the improvement in the ignition means comprising:

a primer receiver having a well with a distal portion and a proximal portion, the distal portion being in communication with the barrel, and the proximal portion having an open end;

the proximal portion having a first diameter nominally greater than the predetermined diameter, and the distal portion having a second diameter nominally less than the predetermined diameter, said second diameter being spaced from the open end a distance less than the predetermined length thereby defining a transition section between the first and second diameters;

whereby the transition section will frictionally engage the forward end of the primer charge cylindrical casing when the primer charge is received in the well through the open end to hold the primer charge casing within the well with the primer charge annular flange exterior of the well and spaced from the well open end.

2. The improvement according to claim 1 wherein the hammer is coaxial with the primer receiver and with the barrel.

3. The improvement according to claim 1 further comprising a pin extending from the hammer in a position to strike such primer charge received in the well, the pin having a diameter substantially less than the predetermined diameter.

4. The improvement according to claim 3 wherein the pin comprises a conical projection extending from the hammer.

5. The improvement according to claim 3 further comprising a stop extending further from the hammer than the pin, to limit movement of the hammer toward such primer charge received in the well.

6. The improvement according to claim 5 wherein the stop comprises an annular flange encircling the pin and extending axially from the hammer.

7. The improvement according to claim 5 wherein the stop comprises an annular flange encircling the pin and extending axially from the hammer.

8. The improvement according to claim 1 further comprising a first face on the primer receiver at the open end, the first face sloping away from the open end.

9. The improvement according to claim 8 wherein the first face slopes away from the opening at an angle greater than 10 degrees, the angle being measured between the first face and a plane normal to a longitudinal axis of the well.

10. The improvement according to claim 8 wherein the first face slopes away from the opening at an approximately 25 degree angle, the angle being measured between the first face and a plane normal to a longitudinal axis of the well.

11. The improvement according to claim 8 further comprising:

a pin extending from the hammer in a position to strike such primer charge received in the well, the pin having a diameter substantially less than the predetermined diameter;

a stop extending further from the hammer than the pin, to limit movement of the hammer toward the primer charge received in the well;

the stop comprising an annular flange encircling the pin and extending axially from the hammer; and the stop terminating in a second face, having a corresponding slope with the first face, whereby the second face can contact the first face in relatively parallel abutment.

12. The improvement according to claim 1 wherein the primer receiver is coaxially positioned within the barrel.

13. The improvement according to claim 12 further comprising a breech plug coaxially positioned within the barrel; the breech plug having a coaxial bore therethrough which receives the primer receiver.

14. The improvement according to claim 1 wherein the transition section comprises a conical wall.

15. The improvement according to claim 1 wherein the transition section comprises an annular shoulder so that when such primer charge has a rounded annular edge at the forward end thereof and is received within the well, the annular shoulder frictionally engages the annular edge to hold the primer charge within the well.

16. In a muzzle loading firearm comprising a barrel, an ignition means for receiving a primer charge comprising a cylindrical casing of predetermined diameter and predetermined length, having an explosive charge within and an annular flange at one end which extends outwardly radially from the casing, and said firearm further having a hammer adapted to ignite the primer charge, the improvement in the ignition means comprising:

a primer receiver having a well with a distal portion and a proximal portion, the distal portion being in communication with the barrel, and the proximal portion having an open end;

the proximal portion having a first diameter nominally greater than the predetermined diameter, and the distal portion having a second diameter less than the predetermined diameter, said second diameter being spaced from the open end a distance less than the predetermined length;

whereby when the primer charge is received in the well through the open end, the cylindrical casing frictionally engages the distal portion at the second diameter to hold the primer charge within the well and with the annular flange spaced from the open end;

a pin extending from the hammer in a position to strike said primer charge received in the well, the pin having a diameter substantially less than the predetermined diameter; and a stop extending further from the hammer than the pin, to limit movement of the hammer toward said primer charge received in the well.

17. In a muzzle loading firearm comprising a barrel, an ignition means for receiving a primer charge comprising a cylindrical casing of predetermined diameter and predetermined length, having an explosive charge within and an annular flange at one end which extends outwardly radially from the casing, and said firearm further having a hammer adapted to ignite the primer charge, the improvement in the ignition means comprising:

a primer receiver having a well with a distal portion and a proximal portion, the distal portion being in communication with the barrel, and the proximal portion having an open end;

the proximal portion having a first diameter nominally greater than the predetermined diameter, and the distal portion having a second diameter less than the predetermined diameter, said second diameter being spaced from the open end a distance less than the predetermined length;

whereby when the primer charge is received in the well through the open end, the cylindrical casing frictionally engages the distal portion at the second diameter to hold the primer charge within the well and with the annular flange spaced from the open end;

a first face on the primer receiver at the open end, the first face sloping away from the open end;

a pin extending from the hammer in a position to strike such primer charge received in the well, the pin having a diameter substantially less than the predetermined diameter;

a stop extending further from the hammer than the pin, to limit movement of the hammer toward such primer charge received in the well;

the stop comprising an annular flange encircling the pin and extending axially from the hammer; and the stop terminating in a second face, having a corresponding slope with the first face, whereby the second face can contact the first face in relatively parallel abutment.

* * * * *